United States Patent [19]

Amuda

[11] Patent Number: 4,694,127

[45] Date of Patent: Sep. 15, 1987

[54] PRESSURE RESPONSIVE SWITCH ASSEMBLY

[75] Inventor: Suarawu O. Amuda, Decatur, Ill.

[73] Assignee: Borg-Warner Automotive, Inc., Troy, Mich.

[21] Appl. No.: 877,062

[22] Filed: Jun. 23, 1986

[51] Int. Cl.[4] ..... H01H 35/34

[52] U.S. Cl. ..... 200/83 P; 92/7

[58] Field of Search ..... 340/626; 73/723; 337/318, 343, 320, 347; 91/1; 92/5 R, 7, 13.2, 101; 200/81 R, 83 R, 83 P, 83 J, 83 S, 83 N, 83 Y, 67 R

[56] References Cited

U.S. PATENT DOCUMENTS

| | | | |
|---|---|---|---|
| 2,824,919 | 2/1958 | Davis | 200/83 P |
| 3,553,402 | 1/1971 | Hire | 200/83 P |
| 4,191,870 | 3/1980 | Yanagisawa | 200/83 P |
| 4,330,695 | 5/1982 | Poling | 200/83 P |
| 4,401,964 | 8/1983 | Payne | 337/343 |
| 4,459,444 | 7/1984 | Charboneau | 200/83 P |

*Primary Examiner*—G. P. Tolin

*Attorney, Agent, or Firm*—John W. Harbst

[57] ABSTRACT

A vacuum operable, snap-action assembly utilizing a metal disc and flexible diaphragm structure to move a switch between first and second positions is disclosed. The switch and disc assembly are provided in a protective housing and are responsive to a pressure differential across the disc and diaphragm structure.

6 Claims, 2 Drawing Figures

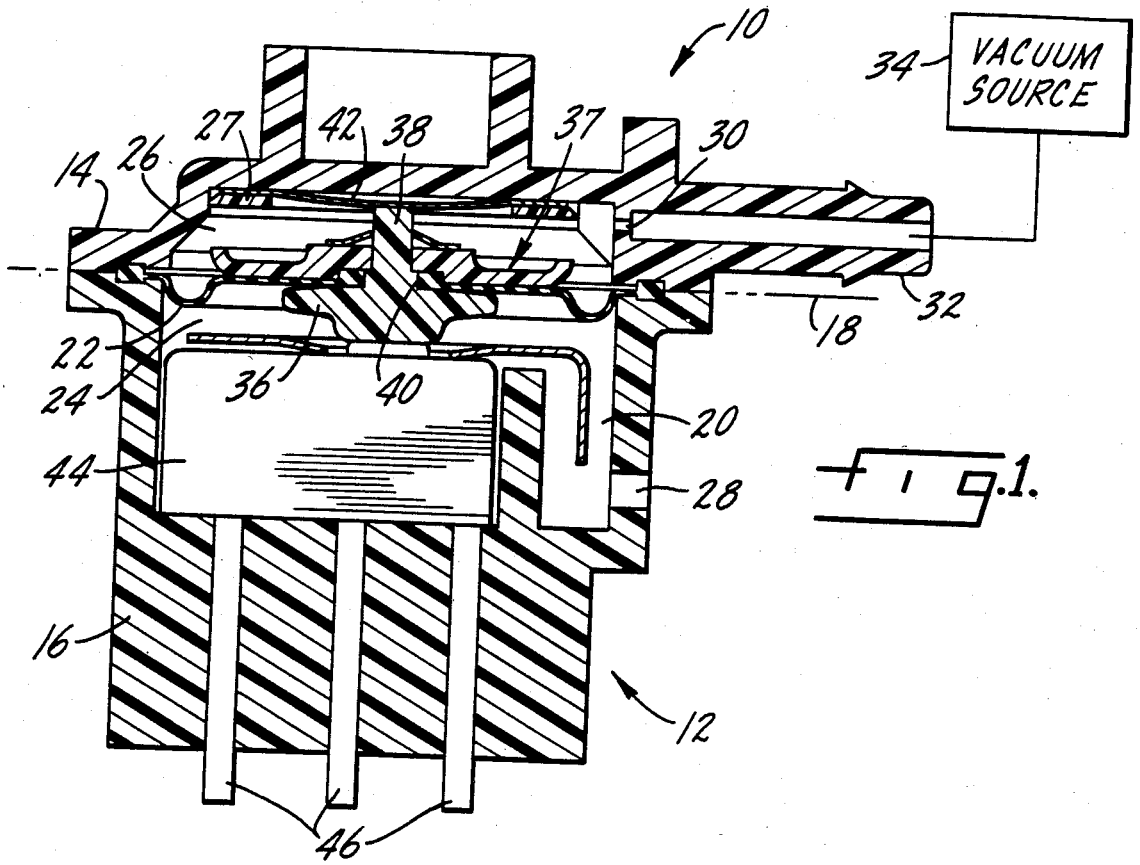
Fig. 1.
Fig. 2.
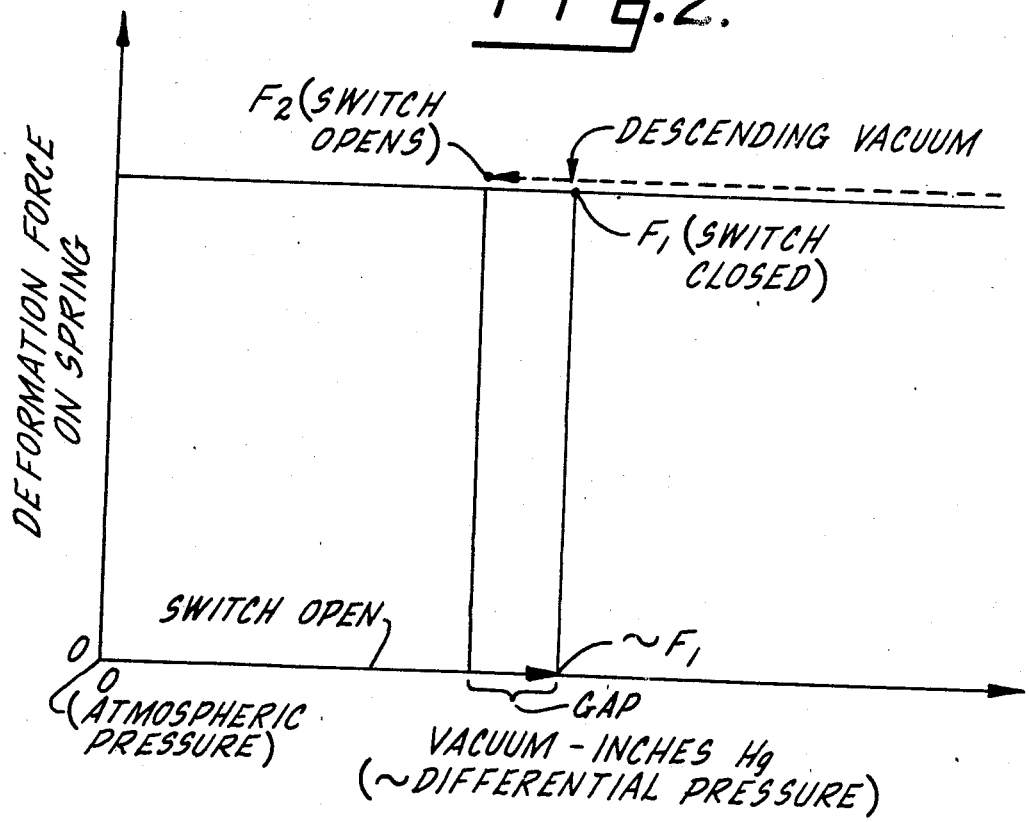

PRESSURE RESPONSIVE SWITCH ASSEMBLY

BACKGROUND OF THE INVENTION

1. Field of the Invention

This invention relates to vacuum operable switches. More specifically the switches are utilized for automobile transmissions, which switches may include snap action discs operable between two distinct positions in response to a pressure differential.

2. Description of the Prior Art

Snap-action switches of various configurations are known and illustrated in the prior art. Various spring and diaphragm arrangements as well as disc operators, have been disclosed for use in pressure-operable switches.

Pressure operable are clearly illustrated by U.S. Pat. Nos. 4,330,695—Poling; 4,328,406—Evans et al; and, 4,145,588—Orcutt. These patents disclose a snap-action disc operator responsive to a fluid pressure to engage and close a switch. In all three patent disclosures, the fluid pressure acts directly on the disc surface to move the switch actuating means.

U.S. Pat. No. 3,867,594—Graf et al illustrates a flexible diaphragm operated stem to deflect a dish-shaped conductor to close a circuit. Alternatively, U.S. Pat. No. 3,816,685—Fiore discloses a pressure operable disc diaphragm utilizing a free-moving stem to close a switch.

Vacuum-operated switches are shown in U.S. Pat. Nos. 4,334,131—Cooper et al and 4,272,660—Mayer et al. In the '131—Cooper et al patent, a rubber piston is spring-biased to maintain contact between two contact wipers and a set of terminals. This device is not a snap-action switch but relies on closing separate circuits at different times with the contact points.

The '660—Mayer et al patent discloses a metal diaphragm that is responsive to a vacuum. The switch includes normally-open and normally-closed poles, and a snap action arrangement changes the switch position therebetween.

The above-noted art describes various pressure activated structures, but the paucity of vacuum-activated switches is indicative of the lack of development in such switches. Pressure-activated devices are a significant factor in the art especially for snap-action switches utilizing resilient metallic, bimetallic or combination metallic-nonmetallic members. The utilization of a rapidly-responsive, pliable diaphragm in cooperation with a metallic resilient device to actuate a snap action function in a switch assures an improved seal to protect the switch means while providing a predetermined hysteresis function of a predictable resilient operator.

SUMMARY OF THE INVENTION

A vacuum operable electric switch assembly is disclosed, which switch utilizes an injection molded housing for a commercially available electric switch. The switch is protected from fluid contamination by a nonmetallic pliable diaphragm responsive to a pressure differential. This same diaphragm is the prime mover for a switch actuation means, which operates against the bias of a resilient disc-shaped member. The disc-shaped member is deformable from a reference position by the diaphragm-actuator movement at a predetermined first pressure differential and is reformable in a snap-action movement to its reference position at a second pressure differential across the diaphragm in a snap-action movement. The actuation means engages the switch, which may be an on-off switch, a switch with a normally-closed and normally-open set of terminals or some other actuation sequences, to change its mode from a reference setting.

DESCRIPTION OF THE DRAWING

The drawing includes the following:

FIG. 1 illustrates a cross-sectional view through a preferred embodiment of the assembly; and FIG. 2 is a graphical illustration of the operating cycle of the invention.

DETAILED DESCRIPTION OF THE DRAWING

A vacuum operable switch assembly 10 is shown in FIG. 1. Assembly 10 comprises a housing 12 including an upper member 14 and a lower member 16, which upper and lower members 14, 16 are joined at line 18 and cooperate to define a cavity or enclosure 20. A flexible diaphragm operator 22 is positioned in cavity 20, and for illustration purposes is shown as secured along parting line 18 between housing members 14 and 16. Diaphragm 22 cooperates with housing 12 to define a reference chamber 24 and a fluid actuation chamber 26, and seals communication between the chambers. Housing 12 includes a reference pressure port 28 communicating between reference cavity 24 and a source of fluid at a reference pressure, which is shown in this case as atmosphere. A vacuum port 30, which may be an orifice, is also provided in housing 12 and communicates through conduit means 32 to a source of fluid at a vacuum 34, where vacuum implies a pressure below atmospheric.

An actuation means 36 is mounted on diaphragm 22 in reference chamber 24, and includes a protuberance 38 extending into actuation chamber 26 through a bore 40 in diaphragm 22. Actuation means 36 and diaphragm 22 cooperate to define diaphragm-actuator means 37. A disc-shaped spring or bias means 42 of a resilient material such as phosphorous-bronze, spring steel, a bimetal or other shape memory type material, is mounted against housing 12 in actuation chamber 26 and retained by retaining means 27. When the switch assembly 10 is assembled, the disc-shaped spring 42 is disposed in the actuation chamber 26 separate or independent from but adjacent to the protuberance 38 on the diaphragm-actuator 37. A commercially available switch means 44 (e.g., snap-action switch, series SS-5 from Omron Switch), which is operable between alternative switching positions, is illustrated as mounted in reference chamber 24 as an assembly with electrode terminals or contacts 46 extending therefrom for coupling to suitable electrically operable devices. The switch assembly means 44 is disposed in the reference chamber 24 such that it is responsive to position changes of but is independently mounted from said diaphragm-actuator means and said disc-shaped means and is protected from variable vacuum fluid contamination by the diaphragm 22. Actuation means 36 contacts switch 44, and protuberance 38 extends through chamber 26 to contact spring disc 42, which biases diaphragm 22 and actuation means 36 downward in the orientation of FIG. 1 toward switch 44 and also relieves the stress in the assembly.

Switch means 44 is operable between alternate first and second positions by actuation means 36, which is movable by diaphragm 22 in response to a pressure differential of a predetermined magnitude between chambers 24 and 26. Spring disc 42 deforms from its reference position at a first differential pressure across diaphragm 22 adequate to overcome its bias force, but does not reform to the reference position until the first pressure differential is reduced to a second pressure differential less than the magnitude of the first pressure differential. Considered in another manner, the disc 42 is deformed elastically by a force of a given magnitude, $F_1$. The disc retains the deformed state until the force is relieved to a force of a different magnitude, $F_2$. Further, $F_2$ is less than $F_1$ and, therefore, the disc 42, will allow switch 44, for example, to open at a first point, $F_1$, but will close at a second point, $F_2$, different than $F_1$. This avoids a hysteresis problem inherent in snap-action switches controllable by diaphragm operators.

The control and operation of an on-off type switch utilizing this structure is graphically illustrated in FIG. 2. Ascending vacuum, that is approaching zero pressure from atmospheric pressure, is plotted along the abscissa and the deformation of disc spring 42 is plotted on the ordinate. As the vacuum increases the differential pressure across diaphragm 22 increases. Disc 42 will not move until force $F_1$ is attained, which force is large enough to move diaphragm 22 and actuation means 36, which operate as a diaphragm-actuator means 37, to elastically deform disc 42. The vacuum can continue to increase but no further measurable deformation of disc 42 will occur. However, as the vacuum descends disc 42 does not reform to its reference position at force $F_1$, but retains its deformed state until the force $F_2$ is achieved. These forces are proportional to vacuum level. $F_2$ is less than $F_1$ and, at force $F_2$, disc 24 will snap back to the reference position and move the diaphragm 22 and actuation means 36 to reset switch 44 to its original position. The distance marked as the gap in FIG. 2 and defined as the difference between $F_1$ and $F_2$ is controllable by the size, shape and material of disc 42 as well as the size of diaphragm 22.

Those skilled in the art will recognize that certain variations can be made in the illustrated embodiments. While only a specific embodiment of the invention has been described and shown, it is apparent that various alternatives and modifications can be made therein. It is, therefore, the intention in the appended claims to cover all such modifications and alternatives as may fall within the true scope and spirit of the invention.

I claim:

1. A pressure responsive switch assembly comprising:

a housing defining an enclosure, a vacuum port and a reference port;

diaphragm-actuator means mounted in said enclosure and cooperating with said housing to define a reference chamber and an actuation chamber;

a source of fluid at a reference pressure communicating with said reference chamber through said reference port;

a source of fluid at a variable vacuum communicating with said actuation chamber through said vacuum port;

disc-shaped means disposed in said actuation chamber separate from but adjacent to said diaphragm-actuator means for maintaining said diaphragm-actuator means at a reference position when said disc-shaped means assumes a first position, said disc-shaped means being deformable to a second position by said diaphragm-actuator means in response to a predeteremined first fluid differential pressure between said actuation chamber and said reference chamber and being reformable to said first position at a second fluid pressure differential less than said first fluid pressure differential; and operative switch means disposed in said reference chamber as an assembly which is responsive to position changes of but is independently mounted from said diaphragm-actuator means and disc-shaped means and which is protected from variable vacuum fluid contamination by said diaphragm actuator means.

2. The invention according to claim 1 wherein said switch assembly means includes terminals extending through said housing.

3. The invention according to claim 1 wherein said disc-shaped means is formed from a phosphorous-bronze material.

4. The invention according to claim 1 wherein said switch assembly is an on-off switch.

5. The invention according to claim 1 wherein said switch assembly means operates between normally open and normally closed positions.

6. The invention according to claim 1 wherein said vacuum port includes an orifice positioned therein to provide a controlled flow between said source of fluid from a variable vacuum and said actuation chamber.

* * * * *